US011013939B2

(12) United States Patent
Jang et al.

(10) Patent No.: US 11,013,939 B2
(45) Date of Patent: May 25, 2021

(54) EASY-WEARABLE PONYTAIL HAIR PACK

(71) Applicant: E.ZCOSTEC Co., LTD., Osan-si (KR)

(72) Inventors: Younghun Jang, Namyangju-si (KR); Youngjun Cho, Hwaseong-si (KR)

(73) Assignee: E.ZCOSTEC CO., LTD., Osan-si (KR)

( * ) Notice: Subject to any disclaimer, the term of this patent is extended or adjusted under 35 U.S.C. 154(b) by 157 days.

(21) Appl. No.: 16/365,908

(22) Filed: Mar. 27, 2019

(65) Prior Publication Data

US 2019/0299031 A1 Oct. 3, 2019

(30) Foreign Application Priority Data

Apr. 2, 2018 (KR) ..... 10-2018-0038104

(51) Int. Cl.

| | |
|---|---|
| ***A61Q 5/00*** | (2006.01) |
| ***A45D 8/34*** | (2006.01) |
| ***A45D 19/16*** | (2006.01) |
| ***A45D 19/00*** | (2006.01) |
| ***A61Q 5/12*** | (2006.01) |

(52) U.S. Cl.

CPC ..... *A61Q 5/002* (2013.01); *A45D 8/34* (2013.01); *A45D 19/16* (2013.01); *A61Q 5/12* (2013.01); *A45D 19/0041* (2021.01)

(58) Field of Classification Search

CPC ... A45D 8/34; A45D 8/36; A45D 8/40; A45D 8/00; A45D 19/0025; A45D 19/0008;

(Continued)

(56) References Cited

U.S. PATENT DOCUMENTS 5,099,865 A * 3/1992 Flannery ..... A45D 19/14 132/212
5,595,199 A * 1/1997 Solomon ..... A45D 8/00 132/273

(Continued)

FOREIGN PATENT DOCUMENTS

KR 20-0236645 Y1 10/2001
KR 30-0745409 S 6/2014

(Continued)

OTHER PUBLICATIONS

Translation of "Hair mask pack for pony tail hair care treatment using an integrated nonwoven fabric", Google, Jan. 8, 2015, https://patents.google.com/patent/KR200475826Y1/en?oq=kr+200475826, Nov. 11, 2020.*

(Continued)

*Primary Examiner* — Jacqueline T Johanas
*Assistant Examiner* — Thomas Drew Agger
(74) *Attorney, Agent, or Firm* — Rabin & Berdo, P.C.

(57) ABSTRACT

Provided is a ponytail hair pack to be easily applied for caring damaged hair just by simple configuration for wearing and making intensive cares allowable at low costs, compared with other normal hair care packs which are uncomfortable for wearing and require a separate rubber band to bind with at the end of ponytail hair after putting the ponytail hair into a hair mask pack and under risks of hair essence being leaked out due to the opening state exposed all the time. However, the ponytail hair pack here allows ponytail hair to be tied firmly by the fixing ties integrally formed with the tie-type pouch, and the stable binding provides comfortable wearing state.

2 Claims, 11 Drawing Sheets

(58) Field of Classification Search
CPC ..... A45D 19/16; A45D 19/18; A45D 2019/0033; A45D 2019/0041; A45D 2019/0066; A45D 2019/0091; A45D 2019/005; A45D 2/46; A45D 7/045; A45D 7/065; A45D 7/001; A45D 7/04; A45D 7/06; A45D 44/08; A61K 8/02; A61K 8/024; A41D 23/00; A61Q 5/002; A61Q 5/12; B65D 33/1608; B65D 31/04; A42B 1/04; A42B 1/041; A42B 1/12
USPC ..... 132/221, 222, 274, 273, 212, 270, 200, 132/203, 204, 205, 206, 207, 208, 210, 132/211; 2/174, 68, 209.3; 383/77, 203, 383/204, 109; 119/868, 869, 602, 653; 424/402
See application file for complete search history.

(56) References Cited

U.S. PATENT DOCUMENTS 5,908,244 A * 6/1999 Galambos ..... B65D 33/165 383/77
2006/0048277 A1* 3/2006 Yeadon ..... A42B 1/225 2/204
2007/0065489 A1* 3/2007 Tojo ..... A45D 19/0025 424/443
2010/0294301 A1* 11/2010 Blasingame ..... A45D 8/40 132/274
2016/0198830 A1* 7/2016 Tussey ..... A45D 8/40 2/183
2018/0213917 A1* 8/2018 Greene ..... A45D 7/00
2019/0037944 A1* 2/2019 Tussey ..... A42B 1/041

FOREIGN PATENT DOCUMENTS

KR 20-0475826 Y1 1/2015
KR 200475826 Y1 * 1/2015 ..... A61K 8/02
KR 10-1813449 B1 12/2017
WO WO-2015102375 A1 * 7/2015 ..... A45D 19/18

OTHER PUBLICATIONS

Korean Office Action dated Aug. 21, 2018.

* cited by examiner

EASY-WEARABLE PONYTAIL HAIR PACK

CROSS-REFERENCE TO RELATED APPLICATION

This application claims priority under 35 U.S.C. § 119 to Korean Patent Application No. 10-2018-0038104 filed on Apr. 2, 2018, the disclosure of which is hereby incorporated by reference in its entirety.

BACKGROUND

1. Field

Embodiments of the present invention relate to an easy-wearable ponytail hair pack, and more particularly, to an easy-wearable ponytail hair pack for taking care of the damaged hair in need of intensive cares and good nutrients by applying to ponytail hair easily with usage of a simple and convenient pack at low costs.

2. Description of Related Art

Generally, hair is mainly made of protein called keratin chemically, and is composed of three layers, that is, cuticle, cortex, and medulla from the root of hair.

The greatest reason among main reasons of hair damages is the protein deterioration physically and chemically occurred on hair protein due to frequent coloring, permanent, drying and so on, and as the result, protein bonding is cut and hair moisture is disappeared through the disconnected protein components.

Particularly, hair becomes more dried and crispy because of protein and moisture loss occurred when cuticle portion of hair comes to be extended due to hair coloring and a hair perm.

Further, hair begins from the root and is grown to be connected to the ends, and the ends of the hair is exposed to the outer environment compared to the root hair portion protected from the hair cuticle layer, so that moisture loss occurs more. Therefore, the ends portion of the hair becomes more damaged than the root portion from where hair comes out and begins because physical and chemical way of treatments are continuously applied while the root portion of the hair comes to be grown and reached toward the ends portion, and the ends portion becomes more and more damaged.

Particularly, most women treat their hair almost everyday by using a hair drier or a hair curler generating hot heat. For one example, when hair comes to be drawn by using the hair curler, and heat is transferred from the hair root portion toward hair ends portion, the hair curler is maintained longer at the hair ends portion, and thus, hair damage is more occurred at the ends portion.

Various products for caring such damaged hair as above are introduced and distributed in the markets. Among them, a type of hair pack is used by the way of applying on wet hair and rinsing by warm water so that hair deposited nutrients components of the hair pack comes to be lost while rinsing, and a type of hair essence is deposited on hair and allows a user normal life as usual while having the hair essence deposited on the hair, but the time of deposition is short and the essence amount deposited on the hair is small so that it is also under the state of being exposed and lost to the air.

Meanwhile, a clinic in high quality salon is very useful and effective even by one time treatment, but the treatment time is very long (minimum 2 hours) and it takes much expenses, and it has many problems that require help hands of hair experts and hair care machines because customers cannot do for themselves.

In consideration of these problems, a product for intensive care of ponytail hair or horse tail hair which describes the hair style that hair is held together and tied at the back or sometimes means short and lump hair style has been developed and introduced recently. One of the existing technology related with this is Korean Patent Registration No. 0475826 which is entitled as 'Hair mask pack for pony tail hair care treatment using an integrated nonwoven fabric'.

The existing technology product is formed as a nonwoven fabric pack having hair treatment ingredients therein and a film integrated together, and an empty pack comes out by opening its opening part, thereby to provide effect of caring user's entire hair including ponytail hair portion by one time wearing.

The existing technology product can be used by putting user's ponytail hair portion into the hair mask pack and holding with rubber band at the catch part of its protruded portion, thereby to fix the hair mask pack at the root of user's ponytail hair, which are inconvenient to wear and uncomfortable to keep wearing. Further, additional separate rubber band is always required to wear and keep the hair mask pack. Furthermore, since its opening part is always in the state of being opened, the hair essence in the hair pack is in the risk of being exposed and lost out.

SUMMARY

Embodiments of the present invention provide an easy-wearable ponytail hair pack for taking care of damaged hair easily by inputting user's ponytail hair into its pack and then, holding the ponytail hair and securing it with its fixing ties integrally formed on its tie-type pouch.

Embodiments of the present invention provide an easy-wearable ponytail hair pack for reducing the loss of hair essence inside the pack by removing a leakage block cover connected on the upper portion of the tie-type pouch by means of a cut-off line and by cutting along its cut-off line at the use of the ponytail hair pack, so as to open an opening part.

Embodiments of the present invention provide an easy-wearable ponytail hair pack for firmly holding and binding the ponytail hair with its fixing ties and preventing the binding of the fixing ties from being untied by making the fixing ties caught on the tie lock grooves formed on the lower sides of the fixing ties.

In accordance with an aspect of the present invention, there is provided a ponytail hair pack for easily applying simple hair treatment way, in which hair is bound together as ponytail hair style, and put into a tie-type pouch of the ponytail hair pack of the present invention and tied by using one pair of fixing ties which are integrally attached on the tie-type pouch of the ponytail hair pack. Therefore, according to the present invention, damaged hair can be intensively and effectively treated by just one time wearing for oneself without help of hair experts or high-expensive hair treatment equipments. Further, since the ponytail hair can be tied by using the fixing ties without any separate tools such as rubber band, production costs can be saved and speed-up effects in use is highly increased.

In accordance with another aspect of the present invention, there is provided a ponytail hair pack which may further include a leakage block cover on the upper side of the tie-type pouch by which a normal opening part of the pouch is not always opened and its opening part can be opened only by removing the leakage block cover at usage time, so that hair essence can be prevented from coming out of the pouch and outer foreign materials are prevented from being put into the pouch, thereby to maintain high and uniform quality of the hair essence all the time.

Further, a plurality of tie lock grooves may be formed on the fixing ties which are useful and helpful to bind and tie the fixing ties together to be caught on the tie lock grooves, which provides a user with more stable and comfortable wearing by the firm and strong binding. Further, dryness and loss of hair essence can be prevented by the tightness of the binding, and hair essence can be well transferred effectively only to the damaged hair.

Further, the fixing ties may be formed of a wet non-woven fabric and a moisturizing outer layer on the entire portions except a sealing part bonded on the boundary edges, so that the binding of the fixing ties can be more effectively made by the soft flexibility provided by the wet non-woven fabric and the moisturizing outer layer. An essence shut-off line may be further formed at the point where the tie-type pouch and the fixing ties meet each other, so that hair essence is prevented from introduced into the fixing ties, but only supplied and intensively focused on the care of ponytail hair.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The foregoing and other features and advantages of the present inventions will be apparent from the more particular description of preferred embodiments of the present inventions, as illustrated in the accompanying drawings in which like reference characters refer to the same parts throughout the different views. The drawings are not necessarily to scale, emphasis instead being placed upon illustrating the principles of the present inventions. In the drawings.

DETAILED DESCRIPTION OF THE EMBODIMENTS

Since exemplary embodiments of the present invention are provided only for structural and functional descriptions of the present invention, the present invention should not be construed as limited to the embodiments set forth herein. Thus, it will be clearly understood by those skilled in the art that the exemplary embodiments of the present invention may be embodied in different forms and include equivalents that can realize the spirit of the present invention. It should be understood, however, that it is not intended to limit the present invention to the particular forms disclosed, but on the contrary, the present invention is to cover all modifications, equivalents, and alternatives falling within the spirit and scope of the present invention as defined by the appended claims.

It will be understood that, although the terms first, second, etc. may be used herein to describe various elements, components and/or sections, these elements, components, and/or sections should not be limited by these terms. These terms are only used to distinguish one element, component or section from another ones. Thus, a first element, component or part discussed below could be termed a second element, component or part without departing from the teachings of the present invention.

Unless expressly defined in a specific order herein, respective steps described in the present invention may be performed otherwise. That is, the respective steps may be performed in a specified order, substantially at the same time, or in reverse order.

The present invention will now be described more fully hereinafter with reference to the accompanying drawings, in which exemplary embodiments of the present invention are shown.

A ponytail hair pack of the present invention, which can be easily employed and wearable on hair of a user that is named herein as easy-wearable ponytail hair pack, can be mainly divided to two components, that is, a tie-type pouch 10 and one pair of fixing ties 20.

Hereinafter, the ponytail hair pack of the present invention, which is roughly composed of the tie-type pouch 10 and the fixing ties 20 as above, will be explained in more detail as below.

Figure 6:
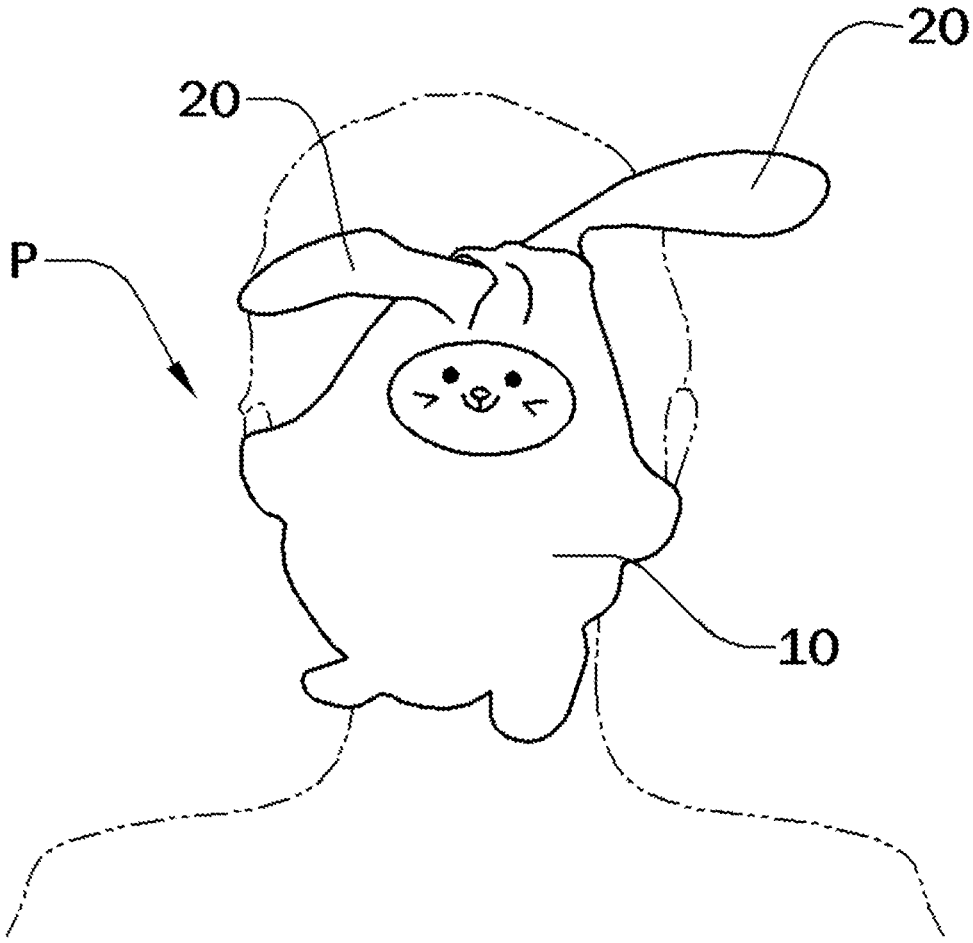
FIG. 6 is a view showing that a ponytail hair pack is worn on the hair of a user according to one embodiment of the present invention.

The tie-type pouch 10 of the present invention is formed to function as a receiving space which enables to cover and receive the ponytail hair of a user thereinside as shown in FIG. 6, and can be applied on and secured with the ponytail hair of a user without use of a separate binding tool such as rubber band, etc. while having the ponytail hair thereinside. Further, the ponytail hair pack of the present invention can be employed and used anywhere and at anytime wanted by a user regardless of space and time being used, such as at home or in offices since it can be formed by well shaping and following various shapes enough to enjoy the eyes of other persons comfortably, such as pet or characters of rabbit, puppy and so on.

Figure 5:
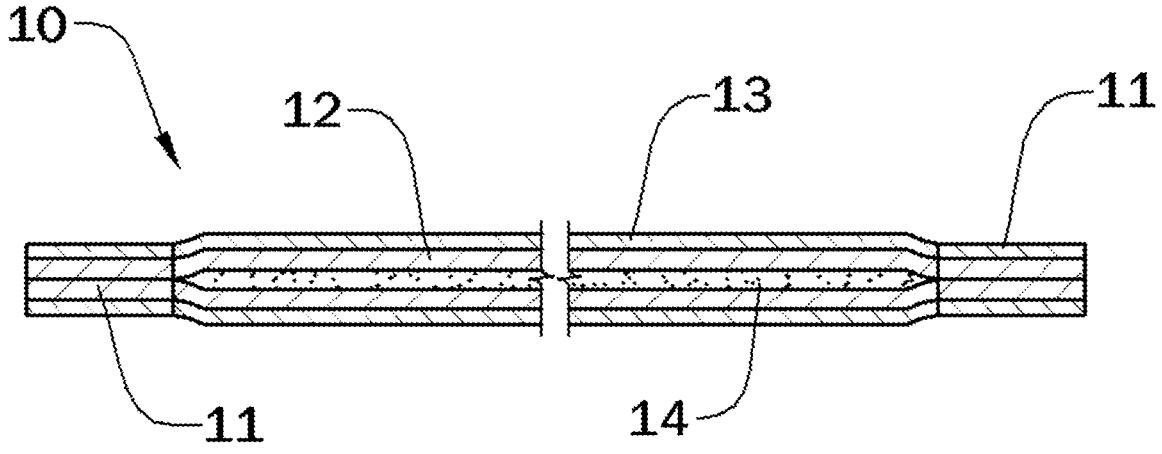
FIG. 5 is a sectional view showing the ponytail hair pack taken along the line of A-A of FIG. 2.

The tie-type pouch 10 includes a sealing part 11 integrally bonded by ultrasonic along the boundary edges of the tie-type pouch 10, a wet non-woven fabric 12 and a moisturizing outer layer 13 deposited on the inside and the outside except for the sealing part 11 as shown in FIG. 5. Ponytail hair can be put into the central space between the layers of the wet non-woven fabric 12, and can be intensively and entirely taken care of by a hair essence 14 which exists between the layers of the wet non-woven fabric 12.

One pair of fixing ties 20 are integrally formed on the both upper sides of the tie-type pouch 10, and the fixing ties 20 are formed by shaping the ears of a rabbit or the ears of a puppy, and the fixing ties 20 are formed to have a length enough to hold the ponytail hair and secure it sufficiently.

Therefore, when holding and fixing the ponytail hair pack P of the present invention having user's ponytail hair put thereinside, one pair of the fixing ties 20 integrally formed on the tie-type pouch 10 are applied to cover the ponytail hair and bound to tie it as shown in FIG. 6, and thus, the ponytail hair pack P of the present invention is easily wearable and the use of a rubber band is eliminated. Therefore, it provides effects of saving in the production costs and increasing the speed up in the usage of the ponytail hair pack.

Further, a plurality of tie lock grooves 25 are formed on the lower both sides of each fixing tie 20 with distanced from each other, in order to enhance the bonding state of the fixing ties 20, so that the fixing ties 20 can be caught firmly on the tie lock grooves 25 when binding the both fixing ties 20, and it can be prevented the fixing ties 20 from being untied and coming loose, thereby to make user's ponytail hair taken care of more effectively.

Figure 7:
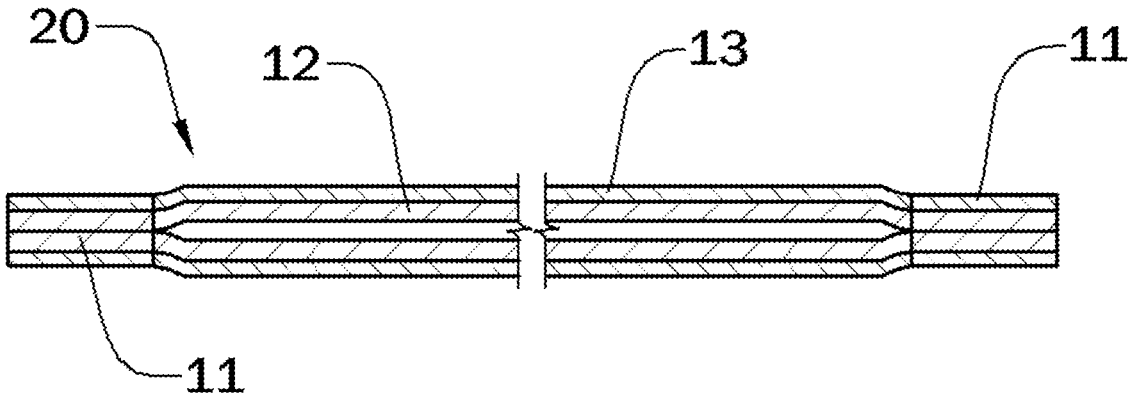
FIG. 7 is a piano sectional view showing the ponytail hair pack taken along the line of B-B of FIG. 4.
Figure 8:
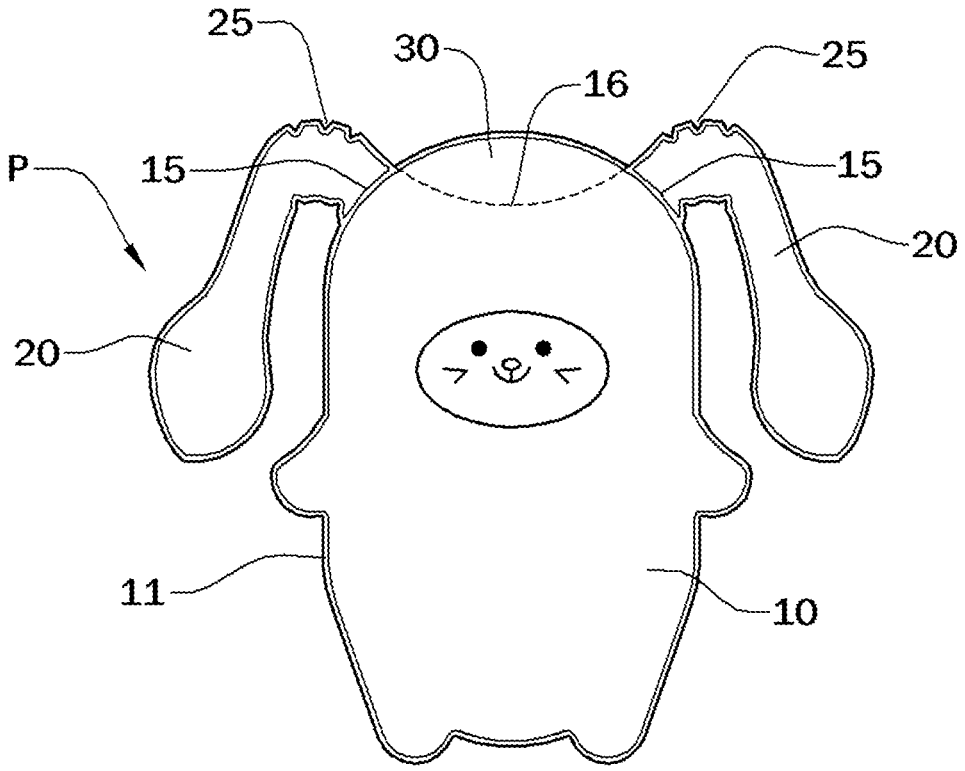
FIG. 8 is a front view of a puppy-style ponytail hair pack according to one embodiment of the present invention.

In the meantime, on the fixing ties 20 is also formed a sealing part 11 integrally bonded by ultrasonic along the boundary edges of the fixing tie 20 as same as in the tie-type pouch 10 as shown in FIG. 7. On the entire portions except for the sealing part 11, a wet non-woven fabric 12 and a moisturizing outer layer 13 are formed inside and outside. By the wet non-woven fabric 12 and the moisturizing outer layer 13 deposited as above, their structure provides excellent soft flexibility, so as to make easily and firmly bind and tie the fixing ties 20. Further, the fixing ties 20 can maintain elasticity like rubber band since the wet non-woven fabric 12 is formed of elastic non-woven fabric and also, the moisturizing outer layer 13 is formed of elastic fabric, so that the binding of the fixing ties 20 can be made much easier and their binding state can be much highly increased. Therefore, it is prevented more effectively that the hair essence 14 is dried up and lost while wearing the ponytail hair pack of the present invention owing to the maintenance of the strong binding of the fixing ties 20 and stable wearing and tightness thereby.

Further, an essence shut-off line 15 is formed on where the tie-type pouch 10 and the fixing tie 20 meet in order to prevent the hair essence 14 from coming into the fixing tie 20. Thus, the hair essence 14 can be stored only inside the tie-type pouch 10 since the essence shut-off line 15 functions to shut off the hair essence 14 coming into the fixing ties 20 unnecessarily, thereby to save and prevent the loss of the hair essence 14 and increase the effect of intensively caring the ponytail hair.

Figure 1:
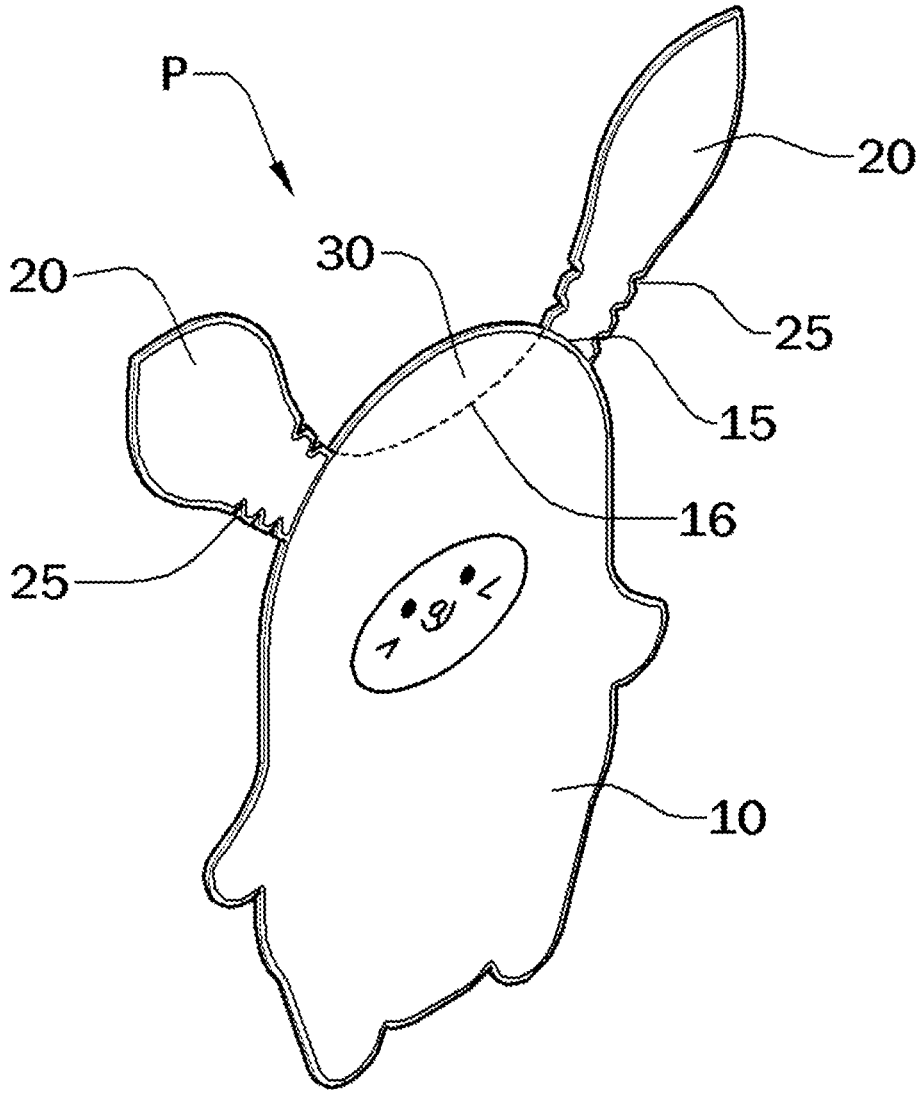
FIG. 1 is a perspective view of a ponytail hair pack according to one embodiment of the present invention.
Figure 2:
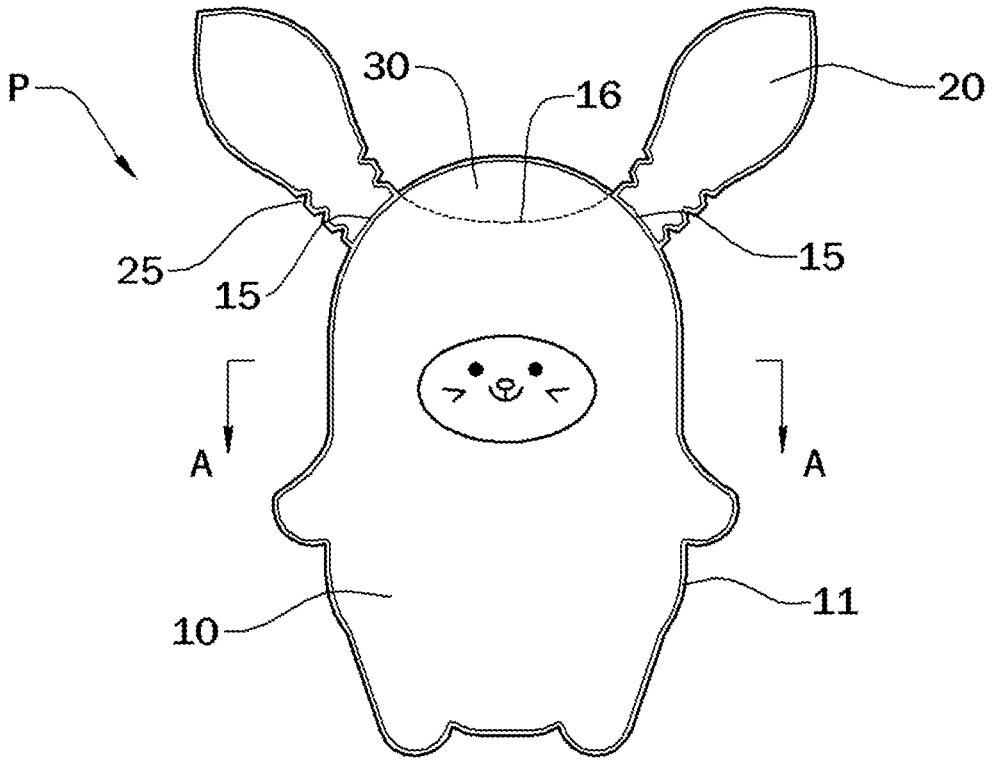
FIG. 2 is a front view of a ponytail hair pack according to one embodiment of the present invention.
Figure 3:
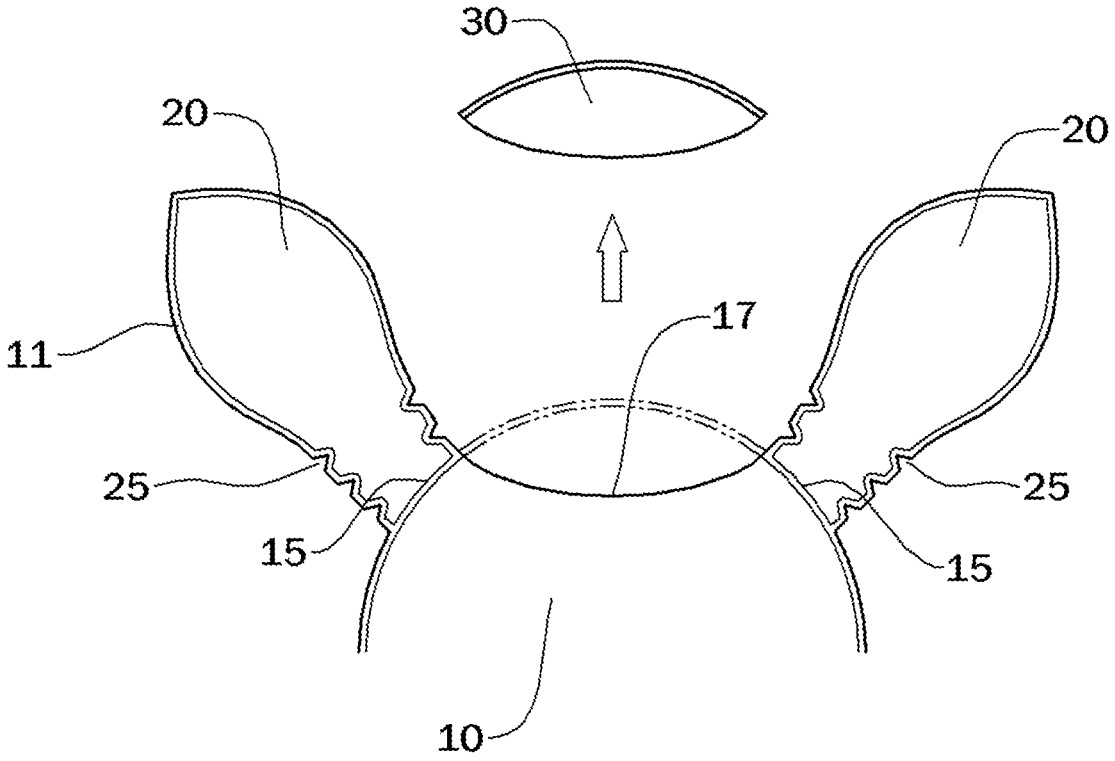
FIG. 3 is a view showing that a leakage block cover is cut and removed from a ponytail hair pack according to one embodiment of the present invention.
Figure 4:
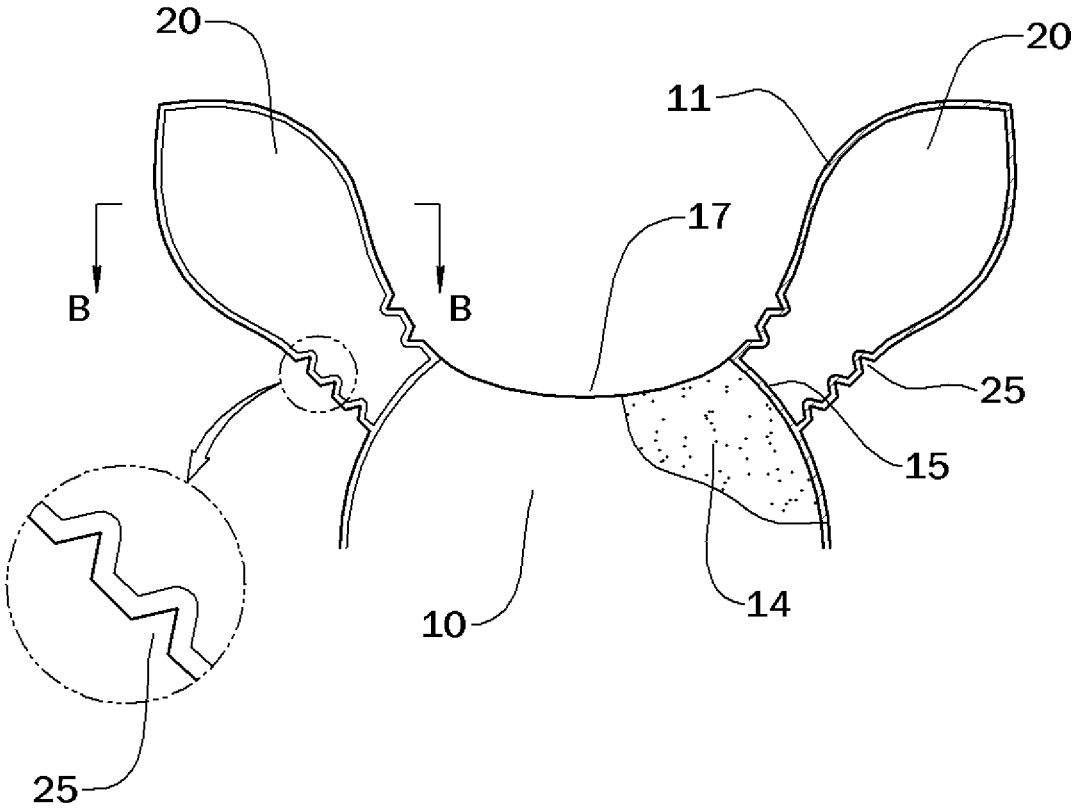
FIG. 4 is a front view partially showing the ponytail hair pack according to one embodiment of the present invention.

Further, a leakage block cover 30 is connected on the upper top of the tie-type pouch 10 with a cut-off line 16 therebetween which is formed to be curved downwards. By the leakage block cover 30, the hair essence 14 inside the tie-type pouch 10 is prevented from being leaked out of the tie-type pouch 10, and outer foreign materials are prevented from being introduced into the tie-type pouch 10. When using the ponytail hair pack P, the leakage block cover 30 can be detached and removed from the tie-type pouch 10 by cutting along a cut-off line 16 as shown in FIG. 3, thereby to make an opening part 17 widened and opened.

Figure 9:
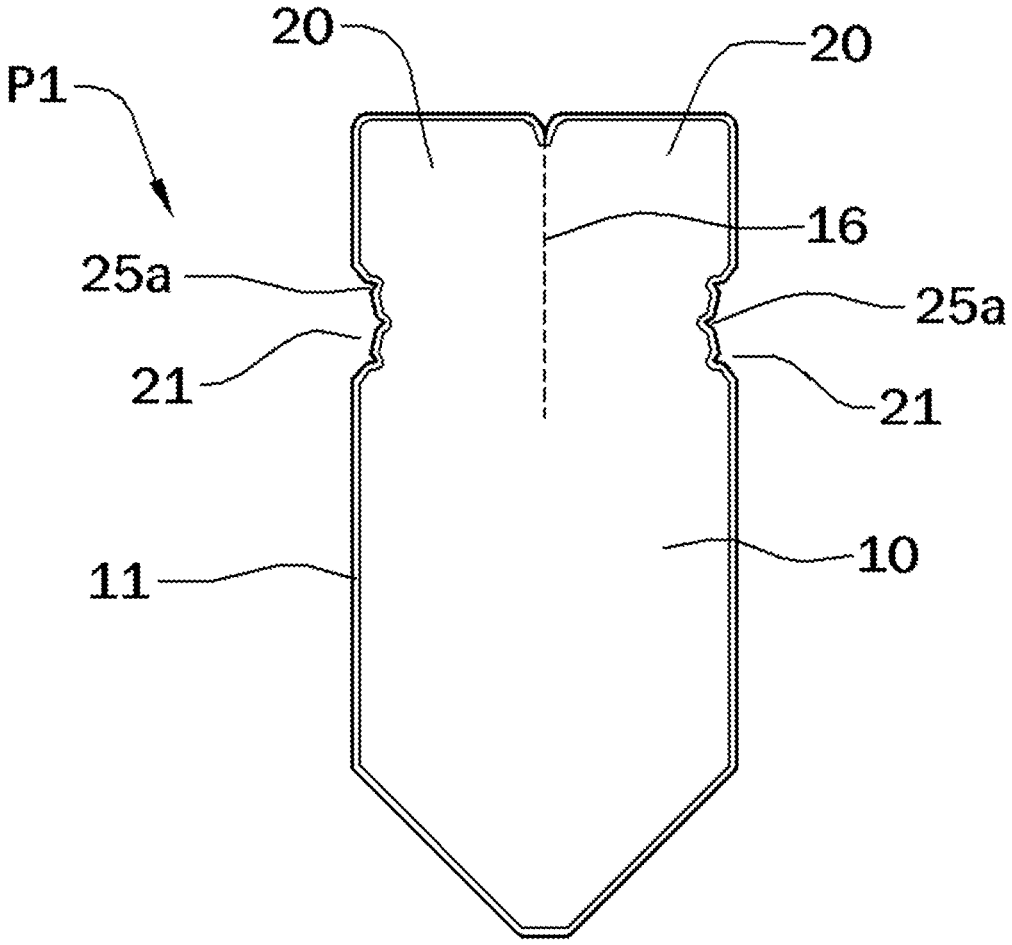
FIG. 9 is a front view of a ponytail hair pack having a cut-off line formed thereon according to another embodiment of the present invention.

In the meantime, the ponytail hair pack P of the present invention can be in pet shapes as well as a shape shown in FIG. 9 as another embodiment of the present invention.

In another embodiment of the present invention, the ponytail hair pack P1 is made to include a tie-type pouch 10 for receiving ponytail hair, and one pair of fixing ties 20 formed on the both upper sides of the tie-type pouch 10 integrally therewith and having the length enough for holding and securing the ponytail hair.

Figure 10:
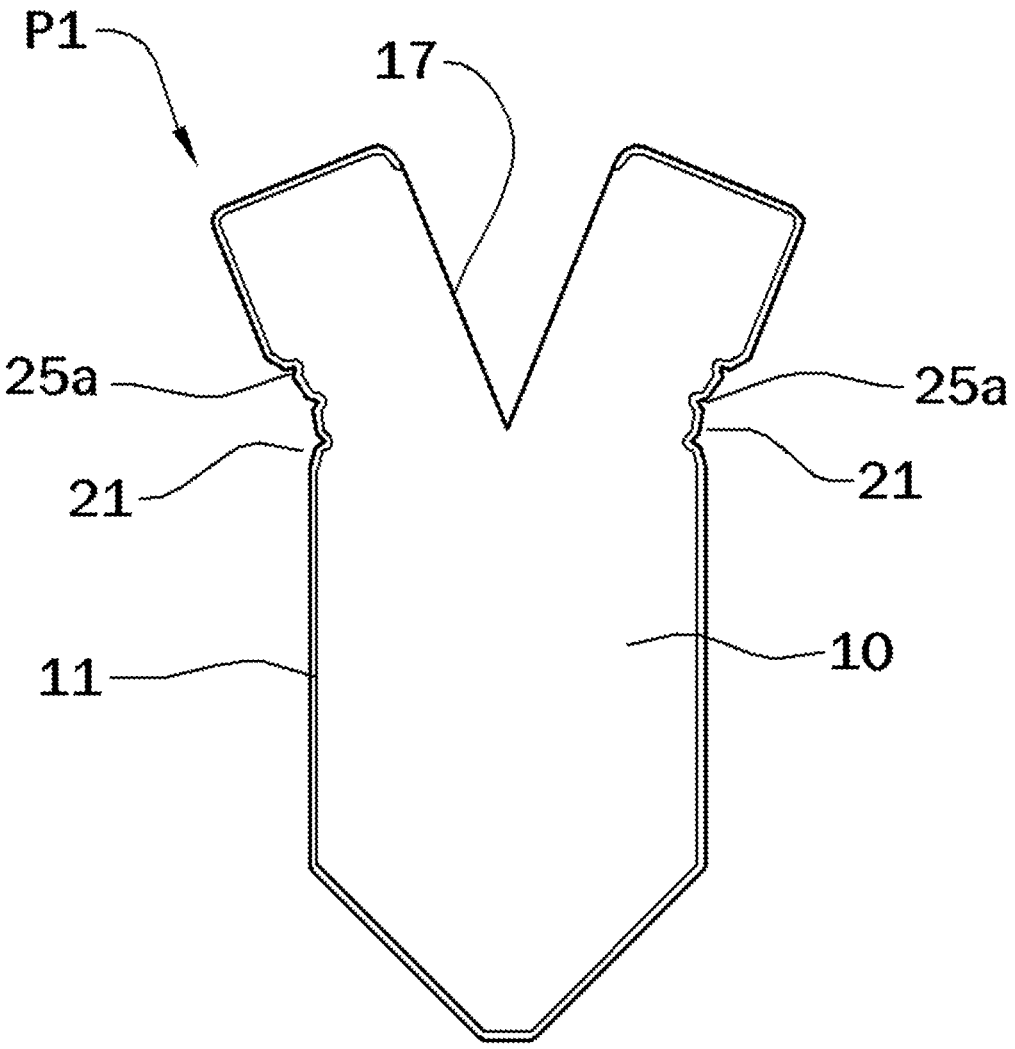
FIG. 10 is a view showing the state that the cut-off line of the ponytail hair pack is cut according to another embodiment of the present invention.

One pair of the fixing ties 20 are connected integrally by a cut-off line 16 which is formed at the center there between. When using the ponytail hair pack P1, the fixing ties 20 should be cut along the cut-off line 16, and divided from each other as shown in FIG. 10, so as to widen and open an opening part 17 for use of the ponytail hair pack P1.

Further, a binding recess part 21 is formed on the lower one side of each of the fixing ties 20 in dented shape in order to make the binding of the fixing ties 20 more firmly and help the width for binding of the fixing ties 20, and a plurality of tie lock grooves 25*a* are formed on each of the binding recess part 21 with distanced apart from each other, so that the fixing ties 20 are caught on the tie lock grooves 25*a* when binding the fixing ties 20, thereby to effectively prevent the fixing ties 20 from being untied and coming to loose.

Figure 11:
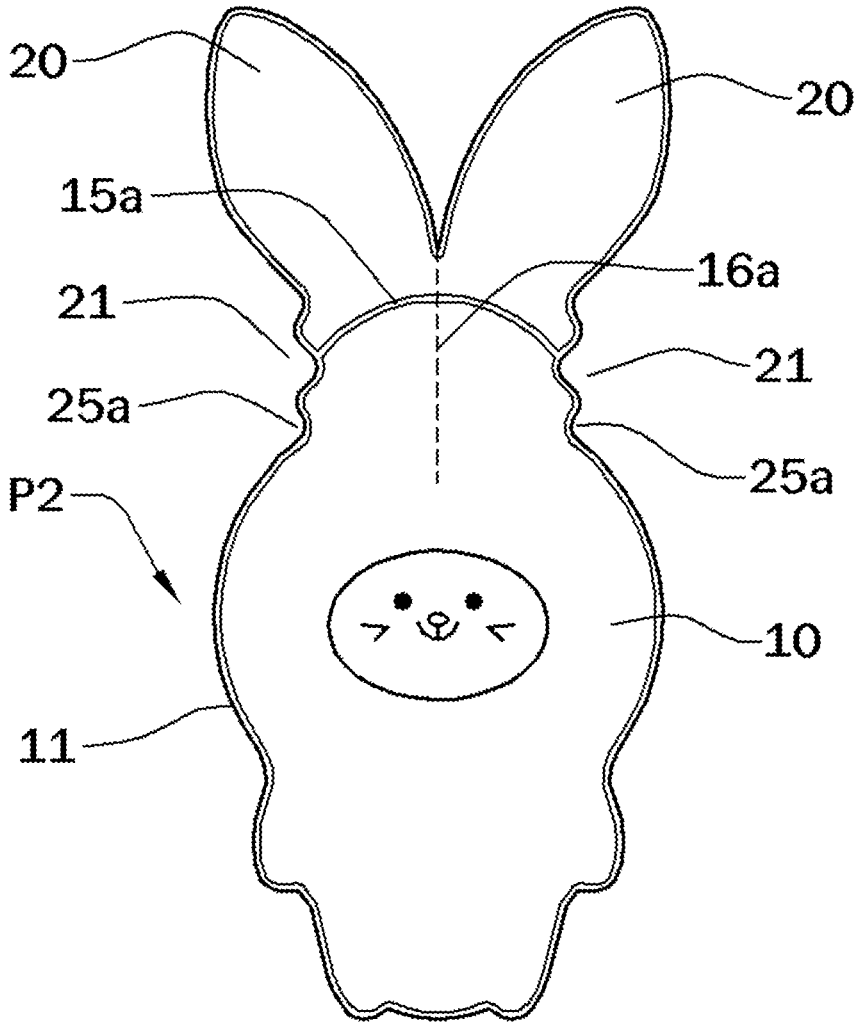
FIG. 11 is a front view of a ponytail hair pack having a cut-off line formed thereon according to still another embodiment of the present invention.
Figure 12:
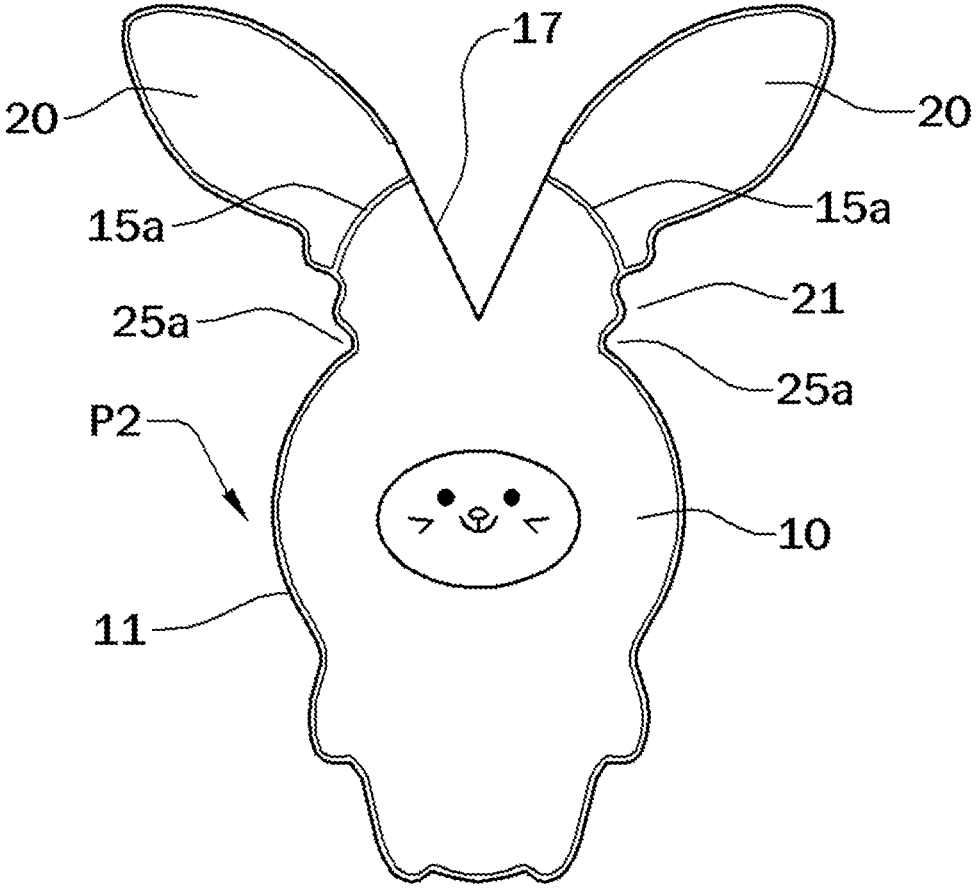
FIG. 12 is a view showing the state that the cut-off line of the ponytail hair pack is cut according to still another embodiment of the present invention.
Figure 13:
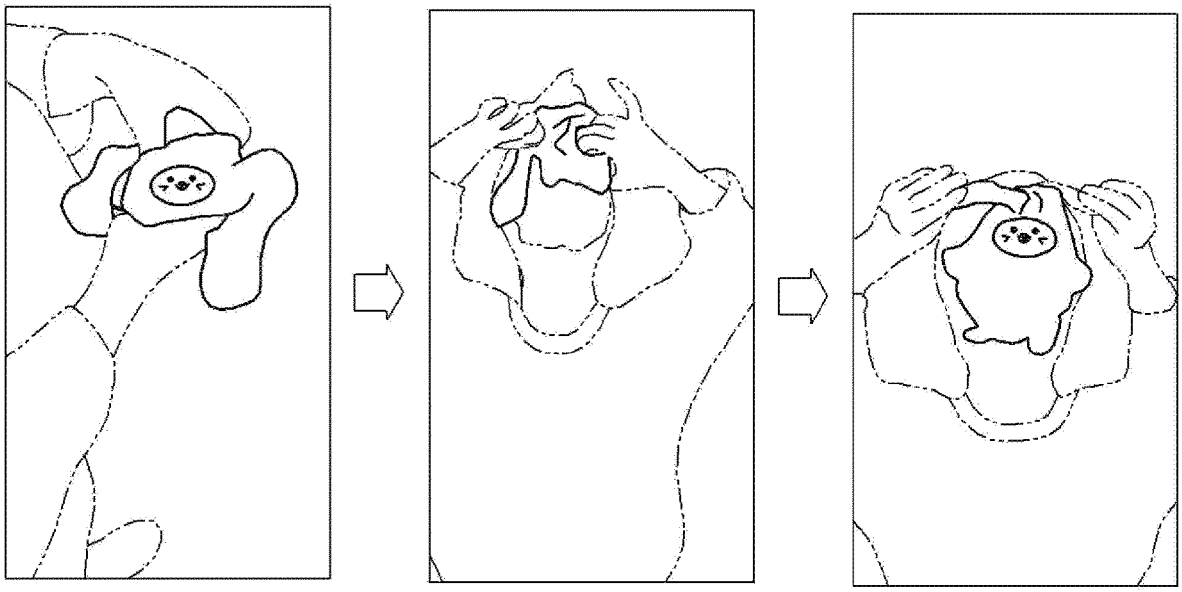
FIG. 13 shows the states of wearing the ponytail hair pack of the present invention.

The present invention can be also realized as ponytail hair pack P2 as shown in FIGS. 11 and 12 according to still another embodiment, in which while entire configuration components are as same as those of the former ponytail hair pack P1 only except that its design is different, in which a puppy is followed after.

Further, in the ponytail hair pack P2 according to still another embodiment of the present invention, an essence shut-off line 15*a* can be additionally formed between the tie lock grooves 25*a* located at the both fixing ties 20, in order to prevent hair essence 14 from being input to the fixing ties 20.

Therefore, according to the present invention, after finishing make-up entirely while wearing the ponytail hair packs P, P1, and P2, and once taking off the ponytail hair packs P, P1, and P2, which received ponytail hair, and drying whole hair, user's damaged ponytail hair can be simply and easily provided with nutrient, moisture, and more volume during facial make-up time.

The foregoing is illustrative of embodiments and is not to be construed as limiting thereof. Although a few embodiments have been described, those skilled in the art will readily appreciate that many modifications are possible without materially departing from the novel teachings and advantages. Accordingly, all such modifications are intended to be included within the scope of this present invention as defined in the claims. In the claims, means-plus-function clauses are intended to cover the structures described herein as performing the recited function, and not only structural equivalents but also equivalent structures.

What is claimed is:

1. An easy-wearable ponytail hair pack comprising:

a tie-type pouch (10) for receiving ponytail hair with two upper sides; and one pair of fixing ties (20), one of the fixing ties integrally formed on each of the upper sides of the tie-type pouch (10) and having the length to cover and bind the ponytail hair, wherein each fixing tie (20) comprises two lower sides and a plurality of tie lock grooves (25) formed on both of the lower sides distanced apart from each other so that the fixing ties (20) are caught in the tie lock grooves (25) when binding the fixing ties (20) so as to prevent them from being untied, a leakage block cover (30) is connected on an upper top of the tie-type pouch (10) with a cut-off line (16) therebetween so that hair essence (14) inside the tie-type pouch (10) is prevented from leaking out, and when using the ponytail hair pack (P), the leakage block cover (30) is detached and removed from the tie-type pouch (10) by cutting along the cut-off line (16), thereby to make an opening part (17) widened and opened, and a wet non-woven fabric (12) and a moisturizing outer layer (13) are formed with deposited inside and outside on the entire portions of the tie-type pouch (10) except a sealing part (11) bonded the boundary edges, so that the hair essence (14) between layers of the wet non-woven fabric (12) takes care of the entire ponytail hair put into and placed between the layers of the wet non-woven fabric (12), and the wet non-woven fabric (12) and the moisturizing outer layer (13) are also formed with deposited inside and outside in each fixing tie (20) on the entire portions except the sealing part (11) bonded on the boundary edges, so that the wet non-woven fabric (12) and the moisturizing outer layer (13) maintains excellent soft flexibility enough to make the fixing ties (20) easily and firmly bound, and an essence shut-off line (15) is formed on where the tie-type pouch (10) and the fixing tie (20) meet in order to prevent the hair essence (14) from coming into the fixing tie (20), and the moisturizing outer layer (13) is formed of elastic fabric, and the wet non-woven fabric (12) is formed of elastic non-woven fabric so that the binding of the fixing ties (20) is easy and their binding state is increased.

2. An easy-wearable ponytail hair pack comprising:

a tie-type pouch (10) for receiving ponytail hair; and one pair of fixing ties (20) integrally formed on upper sides of the tie-type pouch (10) and having the length to cover and bind the ponytail hair, and connected by a cut-off line (16*a*) at a center thereof, so that the fixing ties(20) are divided by cutting along the cut-off line (16*a*) when using the ponytail hair pack (P1)(P2), thereby to widen and open an opening part (17), wherein a binding recess part (21) is formed on a lower side of each of the fixing ties (20) with an indented shape, and a plurality of tie lock grooves (25*a*) are formed on each of the binding recess parts (21) distanced apart from each other, so that the fixing ties (20) are caught on the tie lock grooves (25*a*) when binding the fixing ties (20), thereby to prevent the fixing ties (20) from being untied and becoming loose, and a wet non-woven fabric (12) and a moisturizing outer layer (13) are formed with deposited inside and outside on the entire portions of the tie-type pouch (10) except a sealing part (11) bonded on the boundary edges, so that a hair essence (14) between layers of the wet non-woven fabric (12) takes care of the entire ponytail hair put into and placed between the layers of the wet non-woven fabric (12), and the wet non-woven fabric (12) and the moisturizing outer layer (13) are also formed with deposited inside and outside in each fixing tie (20) on the entire portions except the sealing part (11) bonded on the boundary edges, so that the wet non-woven fabric (12) and the moisturizing outer layer (13) maintains excellent soft flexibility enough to make the fixing ties (20) easily and firmly bound, and an essence shut-off line (15*a*) is formed between the tie lock grooves (25*a*) at both fixing ties (20), in order to prevent hair essence (14) from being input into the fixing ties (20), and the moisturizing outer layer (13) is formed of elastic fabric, and the wet non-woven fabric (12) is formed of elastic non-woven fabric so that the binding of the fixing ties (20) is easy and their binding state is increased.

* * * * *